US005490463A

United States Patent [19]

Lamberty et al.

[11] Patent Number: 5,490,463

[45] Date of Patent: Feb. 13, 1996

[54] MATCH PERFORMANCE .22 CALIBER CARTRIDGE

[75] Inventors: Bruce R. Lamberty, Coon Rapids; Shawn F. Callahan, Minneapolis; Daniel N. Johnson, Andover, all of Minn.

[73] Assignee: Federal-Hoffman, Inc., Anoka, Minn.

[21] Appl. No.: 123,166

[22] Filed: Sep. 20, 1993

[51] Int. Cl.[6] ..... F42B 12/82

[52] U.S. Cl. ..... 102/439; 86/19; 102/430; 102/511; 102/515

[58] Field of Search ..... 86/19; 102/430, 102/435, 439, 471, 501, 511, 515

[56] References Cited

U.S. PATENT DOCUMENTS

| | | | |
|---|---|---|---|
| 1,107,519 | 8/1914 | Hoagland | 102/430 |
| 1,732,211 | 10/1929 | Olin et al. . | |
| 1,780,566 | 11/1930 | Pedersen | 86/19 |
| 2,346,124 | 4/1944 | Dew | 102/511 |
| 3,097,169 | 7/1963 | Hall . | |
| 3,356,029 | 12/1967 | Seidel . | |
| 4,454,175 | 6/1984 | Martin | 102/511 |
| 5,216,199 | 6/1993 | Bjerke et al. | 102/471 |
| 5,275,108 | 1/1994 | Chernicky | 102/439 |

FOREIGN PATENT DOCUMENTS

| | | | |
|---|---|---|---|
| 62-172199 | 7/1987 | Japan | 102/515 |

OTHER PUBLICATIONS

Frost, Ammunition Making—An Insider's Story, The National Rifle Association, 1990.

*Primary Examiner*—Harold J. Tudor
*Attorney, Agent, or Firm*—Schroeder & Siegfried

[57] ABSTRACT

A match performance 0.22 caliber cartridge having improved accuracy provided as a result of being manufactured with an improved base wall construction, and a thinner, less dense, more uniform and more effectively located lubricant coating on the bullet as compared to the 0.22 caliber cartridges utilized heretofore in match competition; and as a result of a lubricant groove which is located most advantageously and is manufactured with an optimum depth.

20 Claims, 2 Drawing Sheets

MATCH PERFORMANCE .22 CALIBER CARTRIDGE

DESCRIPTION

BACKGROUND OF THE INVENTION

There is a continuous demand for increased accuracy in 0.22 caliber ammunition. In addition, there is a continuous demand, for consistent performance of such ammunition when fired within the gamut of the various guns which are utilized, and particularly in match competition. These guns vary in their construction and performance. There are variations in the dimensions of the chambers and in the barrels of guns manufactured by the same manufacturer, and even within those sold by a single manufacturer under a particular trademark. The problem is to build a cartridge which will perform accurately consistently in all of such guns, so as to permit universal usage of guns despite such variations.

We recognize that there are three primary causes of inaccuracies. These are inaccuracies caused in part at least, by the gun, the shooter, and the environment. For example, on windy days it is difficult for the shooter to hold the gun steady. Some shooters tend to pull the gun off target during firing. Wind gusts deflect the bullet off target and also affect the shooters. Each of these causes affects the degree of accuracy which can be reached. Our purpose is to minimize the error from each of them by expediting the movement of the bullet through the barrel and from the barrel to the target.

The period of time which elapses between the striking of the firing pin until the bullet leaves the barrel of the rifle is referred to, in the trade, as lock-time. We have succeeded in diminishing the lock-time so as to thereby increase the accuracy of the bullet. We have improved the ignition characteristics of the cartridge and have adjusted the physical characteristics of the bullet, so as to diminish the lock-time and diminish the adverse effects of the environment to thereby markedly improve the accuracy of the cartridge.

Match performance 0.22 caliber cartridges have typically been cartridges having velocities of approximately 1,070 feet per second. The prior art teaches that if accuracy is to be improved, the velocity of the bullet must be decreased. It can be shown, however, that it is possible to increase the accuracy of the 0.22 caliber bullet substantially while increasing the velocity to a level of 1,130 feet per second to 1,150 feet per second.

It is also known, of course, that the barrel of the rifle in which a 0.22 caliber cartridge is fired, and the air through which the bullet travels after the firing, both exert a drag upon the bullet. In the past a lubricant such as natural waxes (beeswax, for example), or an animal fat (lard, for example), or a mixture thereof have been utilized in an effort to minimize such drag. We have found that we can accomplish a shortening of the travel time and of the lock-time by applying to the bullet a different and synthetic lubricant in a different manner and in a different and lesser thickness. By so doing, we find that we have been able to substantially increase the accuracy of such bullets.

BRIEF SUMMARY OF THE INVENTION

We have found that the application of an improved lubricant, in an improved manner and location, reduces the drag upon the bullet as it passes through the barrel of the gun and the atmosphere as it travels toward the target, thereby aiding in reducing the lock-time and minimizing the environmental effects of the air through which it passes and thus, increasing the accuracy of the cartridge. We have found, by so doing, that in addition to reducing the lock-time, we have been able to reduce the amount of atmospheric drag by about 10–15%. These desirable features have been obtained by selecting a different type of lubricant, as compared to those heretofore conventionally utilized on bullets and applying same in a different manner and under strict location restrictions. Thus, we have selected a synthetic lubricant and have diluted same substantially. We repeatedly dip the nose and forward portion of the bullet in the low-density diluted lubricant, while drying the same in an oven between successive dips, to thereby produce a layered very thin coating of lubricant.

We have also found that the accuracy of these bullets is enhanced by setting the groover knife so as to cut a lube groove having a depth of approximately 0.0125". We have discovered that such a setting of the groove knife causes some of the lead of the bullet to shift into the crimped mouth of the cartridge casing, thereby securing the bullet in the casing in a more firmly secured relationship, and improving the accuracy of the bullet.

Thus, it is an object of our invention to provide a 0.22 caliber match performance bullet having improved accuracy features at a minimum expense. We have found that such bullets provide improved accuracy performance, despite the fact they are utilized in a variety of guns by many different shooters.

BRIEF DESCRIPTION OF THE DRAWINGS

These and other objects and advantages of the invention will more fully appear from the following description, made in connection with the accompanying drawings, wherein like reference characters refer to the same or similar parts throughout the several views, and in which.

DETAILED DESCRIPTION OF THE INVENTION

Figure 1:
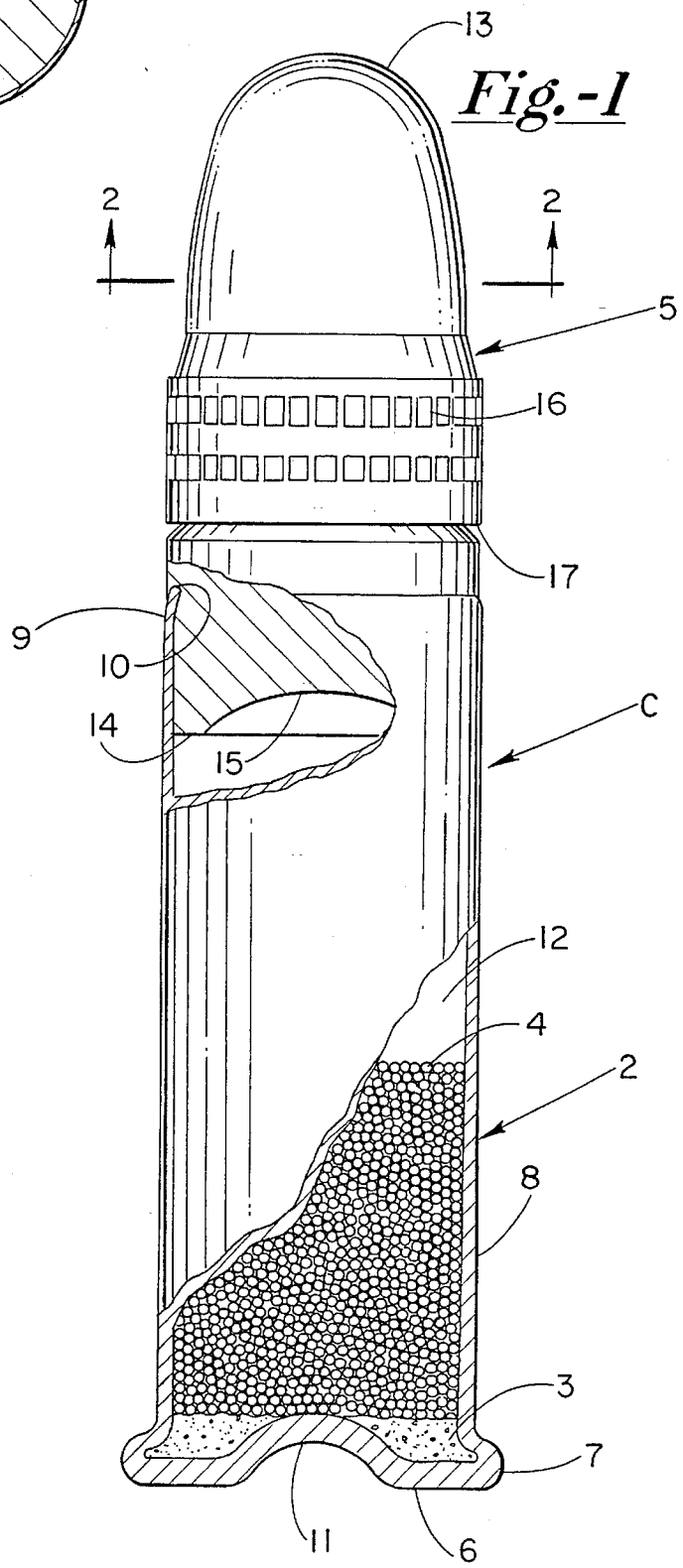
FIG. 1 is an elevational view of our new symmetrically formed 0.22 caliber match performance rimfire cartridge, with portions thereof broken away to show the interior in section.
Figure 3:
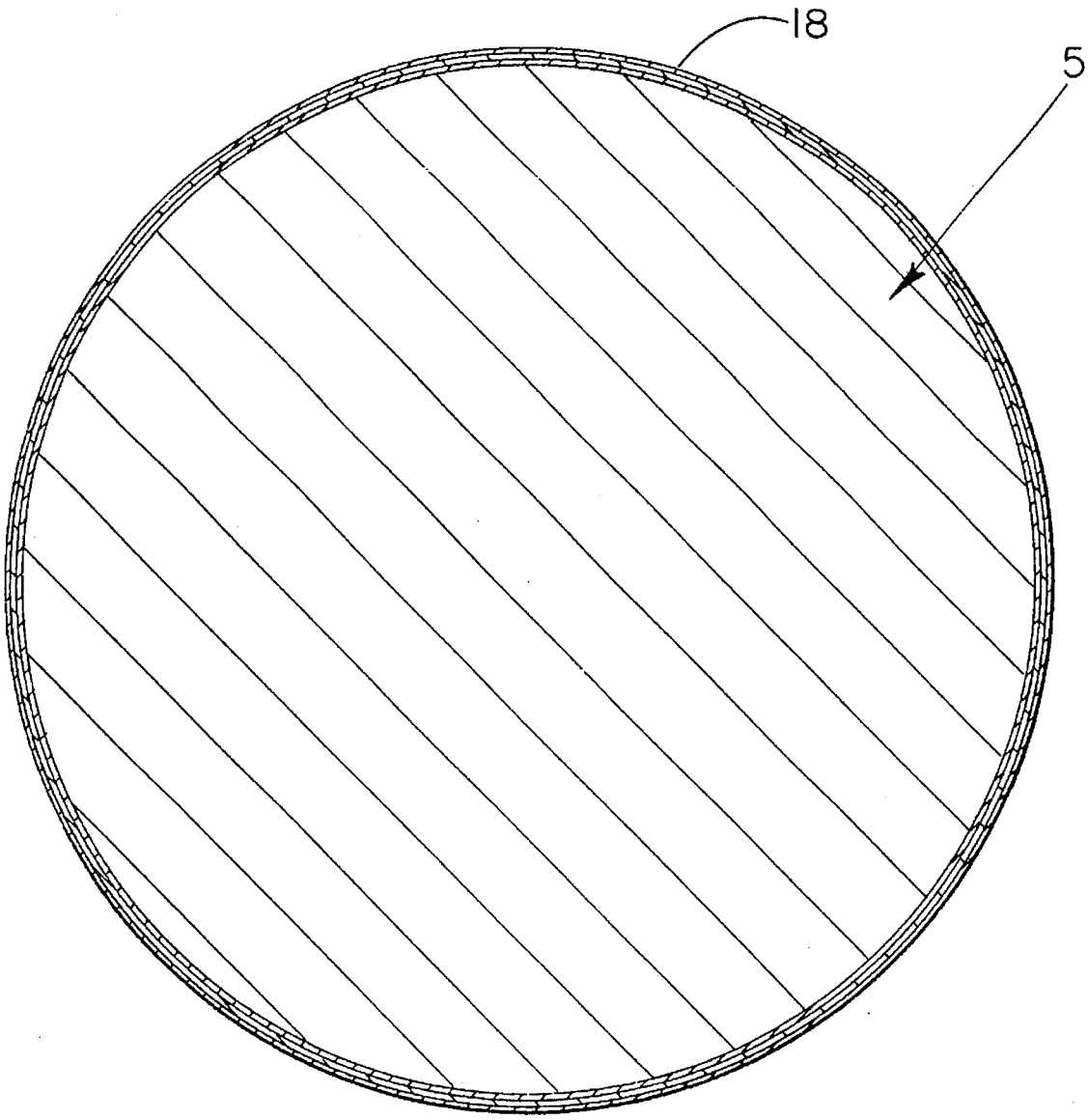
FIG. 3 is a cross-sectional view of a lead bullet of the invention, greatly enlarged to display the multi-layered outer coating of lubricant.

FIG. 1 shows our new 0.22 caliber match performance rimfire cartridge in elevation, with portions thereof broken away to show the interior in section. As shown, the cartridge is symmetrically formed about its longitudinal axis and includes the conventional tubular metal casing 2, a primer 3, a propellant 4, and the bullet 5. As shown, the casing 2 has a head portion 6, a rim portion 7, a main body portion 8, and a mouth portion 9. The latter is crimped into the circumference of the bullet 5 as shown at the upper end of the casing 2 and indicated by the numeral 10. The head portion 6 is characterized by a centrally located dome or dimple 11, which extends upwardly so that the primer 3 surrounds the same and extends outwardly into the rim 7. As shown, the primer 3 bears upon the inner surface of the head 6, surrounding the dome 11. In the manufacture of the cartridge C, the primer 3 is spun into the outer portions of the rim 7, as clearly shown.

Disposed immediately above the primer 3 and bearing thereagainst is the propellant charge 4, which is seen to extend upwardly approximately half-way toward the mouth of the casing 2. The amount of propellant which is utilized is sufficient to propel the bullet 5 toward its target at a velocity in excess of 1,130 feet per second, and ideally at approximately 1,150 feet per second.

As shown by the broken away portion of the drawing in FIG. 1, there is an air space 12 disposed immediately above the propellant and beneath the inner end of the bullet 5.

The bullet 5 is of the conventional shape and has a dome shaped leading tip 13 which increases gradually in diameter toward its rear end 14. The latter has a dome shaped cavity 15 formed centrally therein. This centrally concaved rear end obturates in flight and flattens out upon firing to provide a flat base at the rear end 14 of the bullet. A plurality of knurls 16 are formed on the circumferential surface of the bullet 5 above the lube groove 17. These knurls function to hold lubricant and are used to facilitate gripping of the bullet so as to turn the same against the crimping knife used in the assembly of the cartridge in the conventional manner. The lube groove functions to contain any excess lubricant which may be caused to flow toward the rear end of the bullet while it is passing through the barrel and/or in flight.

It will be seen by reference to FIG. 1 that the mouth portion 9 of the casing 2 is crimped inwardly into the circumferential surface of the bullet 5 so as to firmly secure the bullet to the casing 2. The groove 17 precludes the rearward passage of the lubricant, which is applied to the bullet and which, if it reaches the mouth 10 of the casing 2, will cause the bullet 5 to be secured more loosely within the crimped portion 10 than would otherwise be the case, and thereby diminish the accuracy of the bullet 5.

Figure 2:
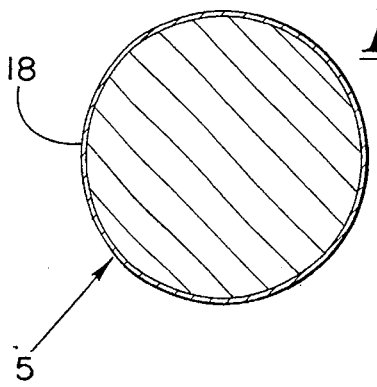
FIG. 2 is a sectional view taken along line 2—2 of FIG. 1.

FIG. 2 is a sectional view taken through the bullet 5 at line 2—2. As shown, it is coated with a very thin coating of lubricant 18 which has been greatly magnified for the sake of illustration. This coating 18 of lubricant is unique in that it is neither beeswax nor an animal fat, nor a combination of the two as is conventionally used upon all 0.22 caliber cartridges, including match performance cartridges. It is also unique in that it is applied in a much different manner and is of a considerably lower and more uniform density.

We have found that the synthetic lubricant sold by Michaelman, Inc., 9089 Shell Road, Cincinnati, Ohio 45236 under the trademark MICHEM LUBE 156NAB, is particularly effective when diluted and applied as hereinafter described. We dilute the same with water to a concentration of 15% by weight of solids, and apply the same incrementally between intermittent drying periods. By so doing, we obtain a highly superior coating of lubricant, and substantially increase the accuracy of the bullet as a result thereof. To accomplish this improved coating of lubricant, we dip the nose portion of the bullet into the above synthetic lubricant to a depth terminating at the lube groove 17. We then dry the lubricant on the bullet with an oven drying cycle after each dip. This procedure is repeated for each of three dips, with the result that the forward portion of the bullet is provided with a very thin multi-layered applied coating of lubricant, comprised of three layers which are not distinct to the naked eye from each other. Wherever hereinafter the term "leading portion" is utilized, it is intended to connote and make reference to the nose portion of the bullet, which is disposed forwardly of the circumferential lube groove 17.

The above synthetic lubricant is comprised of Carnauba wax and sodium benzoate emulsified in a non-ionic wax emulsion emulsifier. The completed film coating has a thickness of 0.0003"–0.0007", the density of the lubricant is 8.3–8.4 pounds per gallon and it has a pH range of 1–14, the preferred pH being 5.5–6.5. A film coating approximating 0.0005" has been found appropriate.

The overall length of the cartridge, as shown, is 0.971"±0.002". The overall length of the casing 8 is 0.606"±0.002". The forwardmost wall of the lube groove 17 is located 0.653"±0.002" from the rearmost surface of the head 6 and 0.318" from the forwardmost tip of the bullet 5. Since the forwardmost wall of groove 17 is located 0.653+/–0.002" from the rearwardmost surface of head 6, it is disposed approximately 0.047" from the casing mouth (0.653"–0.606"=0.047"). Also, the forwardmost walls of the lube groove 17 is disposed approximately 0.318" from the leading tip of bullet (0.971+/–0.002"–0.653+/–0.002"= 0.314–0.322", which is the equivalent to 0.318"). The forwardmost portions of the knurls 16 are located at 0.7360"±0.002" from the most rearward surface of the head 6.

Our tests have shown that the best accuracy results are obtained if the bullets are dipped nose-first into the diluted stock solution of the lubricant to a minimum depth of 0.298" and to a maximum depth of 0.318". If the lubricant is applied as described and to the depth indicated, substantially improved results are obtained in the accuracy of the bullets.

We believe that the improved accuracy is obtained as a result of the provision of a more uniform and thinner layer of lubricant, which has a uniform density and is distributed uniformly in a very thin layer over the exterior surface of the bullet. As a result of this type of lubricant coating, the substantial lag resulting from the bullet traveling through the air is substantially diminished and as a consequence, the accuracy of the bullet is greatly increased. It appears that the thinness of the layer, as well as the uniform distribution of the lubricant, has a substantial impact to provide the improved results. It is also believed that the composition of the lubricant may be a factor in the improved performance, since it has been conventional heretofore, to utilize either beeswax or an animal fat, or a mixture of both, as the lubricant to be applied to the nose portion of the bullet.

It will be noted that the synthetic lubricant is applied to the nose portion of the bullet, and is not applied rearwardly beyond the forwardmost wall portion of the groove 17. This rearward limit is applied in order to preclude the passage of lubricant into the crimped mouth portion of the casing 8 which, it has been found, will loosen the bullet within the casing and thereby adversely effect its accuracy.

We also believe that the substantial depth (0.025") of the groove provides a desirable effect upon the fixation of the bullet within the casing. It appears that the increased extension of the groove knife, to provide the deeper lube groove 17, forces some of the metal of the bullet inwardly into the crimped mouth portion of the casing 8, thereby increasing the security of the grip of the crimped mouth portion of the casing upon the bullet 5. It appears that this also improves the accuracy of the bullet.

It should be noted that the improved coating of synthetic lubricant also diminishes the lock-time, since it reduces the drag of the barrel, because of the lower density of the lubricant and its uniform and thin application. It is also believed that the arrangement of the primer compound 3 around the dome 11 of the head 6 reduces the ignition phase, and provides a more uniform burn to uniformly ignite the propellant 4. It is believed that the flame moves both around the dome 11 and forwardly simultaneously to provide a more efficient ignition and effectively improve the accuracy as a result of reduction of lock time. It is believed, however, that the concentration and consistency of the synthetic lubricant is the most important aspect in providing the increased accuracy which has been attained. This increased accuracy results from the reduction of lock-time, and the diminishing of the drag on the bullet during its aerodynamic flight. Since the time required for its aerodynamic flight has been reduced, the effect of the wind thereupon and therefor upon its accuracy, has been diminished, because the bullet is disposed within the air for a lesser period of time.

It will, of course, be understood that various changes may be made in the form, details, arrangement and proportions of the parts without departing from the scope of the invention which comprises the matter shown and described herein and set forth in the appended claims.

We claim:

1. A match performance 0.22 caliber cartridge comprising:

(a) a metal casing having head, rim, main body, and mouth portions;

(b) a bullet mounted within said mouth portion and having a leading portion extending forwardly of a circumferential lube groove formed therein;

(c) primer compound located within said rim portion and bearing against said head portion;

(d) propellant located within said main body portion in close proximity to said primer compound;

(1) said propellant being disposed within said main body portion in sufficient quantity to propel said bullet, upon firing of the cartridge, at a velocity within the range of 1,130–1,150 feet per second, and (e) a coating of synthetic lubricant carried by only said leading portion of said bullet, said coating being of a thickness within the range of 0.0004"–0.0007".

2. The cartridge defined in claim 1, wherein the thickness of said coating is approximately 0.0005".

3. The cartridge defined in claim 1, wherein said coating of synthetic lubricant has a density within the range of approximately 8.3–8.4 pounds per gallon.

4. The cartridge defined in claim 1, wherein said coating of synthetic lubricant is a layered coating.

5. The cartridge defined in claim 1, wherein said bullet has a leading tip, said coating extending continuously from said leading tip only to a point adjacent the forward most portion of said lube groove.

6. The cartridge defined in claim 1, wherein said coating of synthetic lubricant is comprised of a synthetic wax material.

7. The cartridge defined in claim 1, wherein said coating of synthetic lubricant is comprised of diluted Carnauba wax and sodium benzoate.

8. The cartridge defined in claim 1, wherein the thickness of said coating is approximately 0.0007".

9. A match performance 0.22 caliber cartridge comprising:

(a) a metal casing having head, rim, main body, and mouth port ions;

(b) a bullet mounted within said mouth portion and having a leading portion extending forwardly of a circumferential lube groove formed therein;

(c) primer compound located within said rim portion and bearing against said head portion;

(d) propellant within said main body portion in close proximity to said primer compound;

(1) said propellant being disposed within said main body portion in sufficient quantity to propel said bullet, upon firing of the cartridge, at a velocity within the range of 1,130–1,150 feet per second, and (e) a coating of synthetic lubricant carried by only said leading portion of said bullet and extending to said lube groove, said coating being of a thickness within the range of 0.0004"–0.0007".

10. The cartridge defined in claim 9, wherein said coating has a thickness approximating 0.0005".

11. The cartridge defined in claim 9 wherein said coating of synthetic lubricant upon application has a density of approximately 8.3–8.4 pounds per gallon.

12. The cartridge defined in claim 9 wherein said casing has a mouth and said lube groove is disposed approximately 0.047" from said casing mouth.

13. The cartridge defined in claim 9, wherein said lube groove has a depth of approximately 0.0125".

14. A match performance 0.22 caliber cartridge comprising:

(a) a metal casing having head, rim, main body, and mouth portions;

(b) a bullet mounted within said mouth portion and having a leading portion extending forwardly of a circumferential lube groove formed therein;

(c) primer compound located within said rim portion and bearing against said head portion;

(d) propellant within said main body portion in close proximity to said primer compound;

(1) said propellant being disposed within said main body portion in sufficient quantity to propel said bullet upon firing of the cartridge, at a velocity within the range of 1,130–1,150 feet per second, and (e) a layered coating of synthetic lubricant carried by only said leading portion of said bullet, said coating being of a thickness within the range of 0.0004"–0.0007" and said synthetic lubricant upon application having a density within the range of approximately 8.3–8.4 pounds per gallon.

15. The cartridge defined in claim 14, wherein said groove is positioned approximately 0.318" from a nose of the bullet.

16. The cartridge defined in claim 14, wherein said lube groove has a depth of approximately 0.0125".

17. The cartridge defined in claim 14, wherein said lube groove is disposed at a location within the range of 0.314"–0.322" from a leading tip of said bullet.

18. The cartridge defined in claim 14, wherein said bullet has a velocity approximating 1,150 feet per second.

19. The cartridge defined in claim 14 wherein said layered coating of synthetic lubricant extends within the range of 0.314"–0.322" from a leading tip of the bullet.

20. The cartridge defined in claim 14, wherein said lube groove is disposed adjacent said mouth portion of said casing.

* * * * *

UNITED STATES PATENT AND TRADEMARK OFFICE

CERTIFICATE OF CORRECTION

PATENT NO. : 5,490,463

DATED : February 13, 1996

INVENTOR(S) : Lamberty et al

It is certified that error appears in the above-identified patent and that said Letters Patent is hereby corrected as shown below:

Column 4, line 48, "(0.025")" should be --(0.0125")--

Signed and Sealed this

Ninth Day of July, 1996

*Attest:*

*Attesting Officer*

BRUCE LEHMAN

*Commissioner of Patents and Trademarks*